United States Patent [19]

Mathews et al.

[11] Patent Number: 5,035,466

[45] Date of Patent: Jul. 30, 1991

[54] ERGONOMIC CHAIR

[75] Inventors: Marty K. Mathews, Rhinelander, Wis.; Jeffrey A. Weber, Minneapolis, Minn.

[73] Assignee: Krueger International, Inc., Green Bay, Wis.

[21] Appl. No.: 332,796

[22] Filed: Apr. 3, 1989

[51] Int. Cl.[5] ..... A47C 1/02

[52] U.S. Cl. ..... 297/337; 297/353; 297/349; 297/410; 248/561

[58] Field of Search ..... 297/337, 346, 349, 353, 297/383; 248/561, 429, 419, 582

[56] References Cited

U.S. PATENT DOCUMENTS

| | | | |
|---|---|---|---|
| 2,339,953 | 1/1944 | Schlorman | 297/349 X |
| 2,547,455 | 4/1951 | Freeman | 297/353 X |
| 2,606,595 | 8/1952 | Mednick | 248/582 |
| 3,065,828 | 11/1962 | Caldemeyer | 248/561 X |
| 3,511,533 | 5/1970 | Drabert | 297/337 |
| 3,910,633 | 10/1975 | Marsh | 297/349 |
| 4,017,118 | 4/1977 | Cawley | 297/410 |
| 4,102,549 | 7/1978 | Morrison | 297/383 |
| 4,432,582 | 2/1984 | Wiesman et al. | 297/353 |
| 4,555,085 | 11/1985 | Bauer et al. | 248/561 |
| 4,664,445 | 5/1987 | Groseth | 248/561 X |

*Primary Examiner*—Laurie K. Cranmer

*Attorney, Agent, or Firm*—Fuller, Ryan & Hohenfeldt

[57] ABSTRACT

An ergonomic chair of simplified design includes a seat support member, a backrest support member, and a base member to which the seat support member and the backrest support member are both attached. The base member engages the seat support member in a manner that permits movement of the seat support member between a forward seated position and a rearward seated position. The base member also engages the backrest support member in a manner that permits movement of the backrest support member independent of the movement of the seat support member in a first direction toward the base member and in a second direction away from the base member. The base member also serves to tilt the base member forwardly and rearwardly about a horizontal axis.

22 Claims, 7 Drawing Sheets

72
74
68
70
94
92
84
24
26
22
62
14
10
44
46
50
12
40
42
42
32
58A
59
58B
58
58B
58A
66
54
38
38
30
52
44
36
80
64
92
50
48
16
76
84
78
102
98
104
104
106A
100
106B
18

ERGONOMIC CHAIR

FIELD OF THE INVENTION

The invention generally relates to chairs suitable for home or office use. More particularly, the invention relates to chairs that are adjustable to meet differing physical and physiological demands of users.

BACKGROUND OF THE INVENTION

Chairs that adjust to the differing physical and physiological requirements of people are known. Heretofore, the desired ergonomic features were often obtained at the price of complexity, requiring relatively bulky and complicated mechanisms that are difficult for a company to manufacture and for the user to assemble on site.

There thus remains a demand for user adjustable chairs that contain a minimum of component parts and that are lightweight and easy to assemble on site, but at the same time provide the user with all the desired ergonomic functions, such as back-to-seat depth adjustment, forward and rearward tilt, back height adjustment, and passive lumbar support.

SUMMARY OF THE INVENTION

The invention provides a user adjustable chair that provides principal ergonomic features in a simplified and straightforward manner to accommodate in comfort people of differing physical and physiological requirements. The straightforward design of the chair simplifies manufacturing and provides ease of assembly on site.

The chair that embodies the features of the invention comprises a seat support member, a backrest support member, and a base member to which the seat support member and the backrest support member are attached. The base member engages the seat support member in a manner permitting movement of the seat support member between a forward seated position and a rearward seated position. The base member also engages the backrest support member in a manner permitting movement of the backrest support member, independent of the movement of the seat support member, toward and away from the base member. The invention thus provides, with a single base member, the very desirable ergonomic feature of back-to-seat depth adjustment from two standpoints; that is, by movement of the seat relative to the back, and vice versa.

In a preferred embodiment, the invention accommodates seat movement relative to the base member with a minimum of component parts. In this arrangement, the base member includes a channel having a generally dovetail-shaped configuration and a runner having a mating dovetail-shaped configuration that is slidably engaged within the channel. The seat support member can be attached to either the channel or the runner. The mating dovetail-shaped configurations of these two parts permit the desired movement of the runner within the channel, while at the same time preventing lateral separation of the channel and the runner. In this arrangement, the base member preferably limits the relative movement of the channel and the runner between two selected laterally spaced positions.

Another aspect of the invention provides pivot means for tilting the base member, and thus the attached seat support member, forwardly and rearwardly about a horizontal axis. In a preferred embodiment, an associated control mechanism selectively permits tilting of the base member in either a forward or rearward direction, while preventing pivotal movement of the base member in the other direction. The invention thereby selectively provides the desirable ergonomic feature of forward and rearward tilt.

The invention also provides a chair having a functional member that is selectively adjustable by the user. In accordance with this aspect of the invention, the chair includes locking means for the adjustable member that comprises a low profile lever arm pivotally movable on the chair and camming means that is brought into and out of locking contact with the adjustable member in response to movement of the lever arm. Operation of the lever arm serves to selectively lock and unlock the adjustable member in a desired relationship with the seat support member.

In a preferred embodiment, the locking means biases the camming means toward locking contact with the adjustable member in response to a force that is normally applied by the user when seated in the chair. The invention thereby provides an automatic self-locking feature to assure that the adjustable member remains in the location set by the user.

Other features and advantages of the invention will become apparent upon considering the accompanying drawings, description, and claims.

DESCRIPTION OF THE PREFERRED EMBODIMENTS

Figure 2:
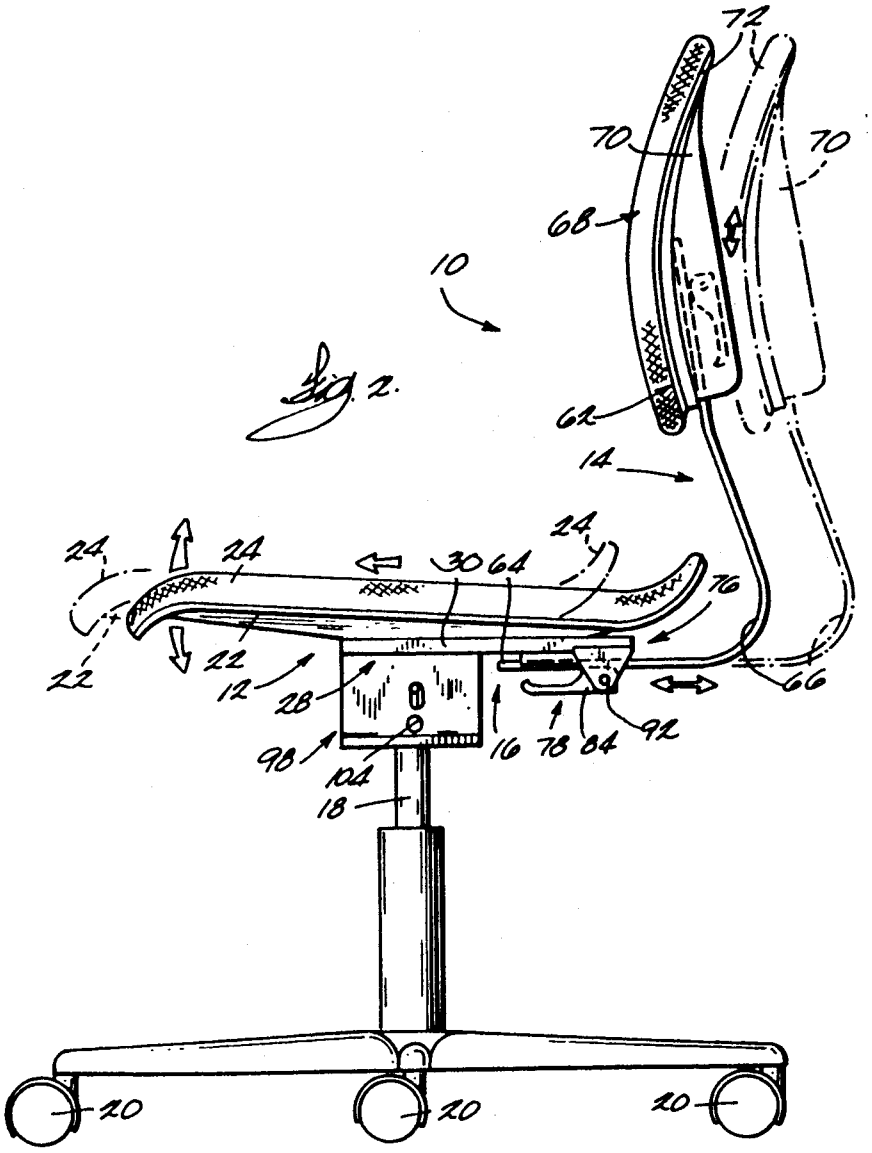
FIG. 2 is a side elevation view of the chair shown in FIG. 1.
Figure 1:
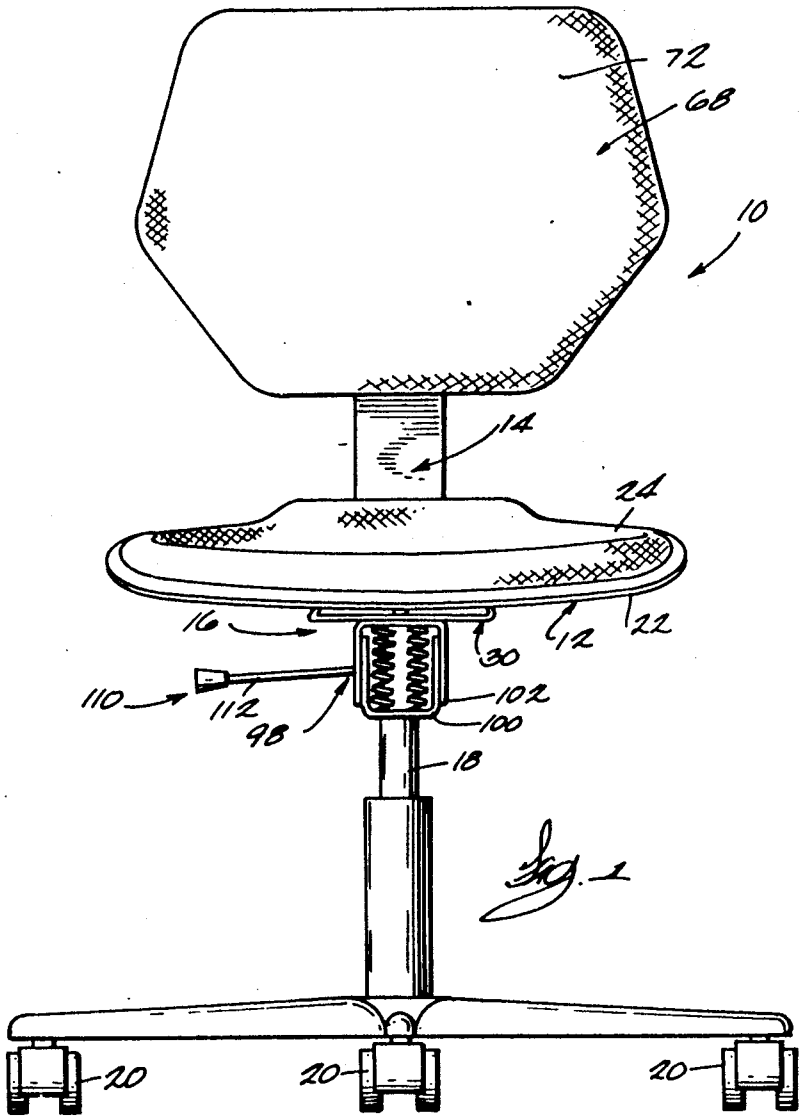
FIG. 1 is a front elevation view of a chair that embodies the features of the invention.
Figure 3:
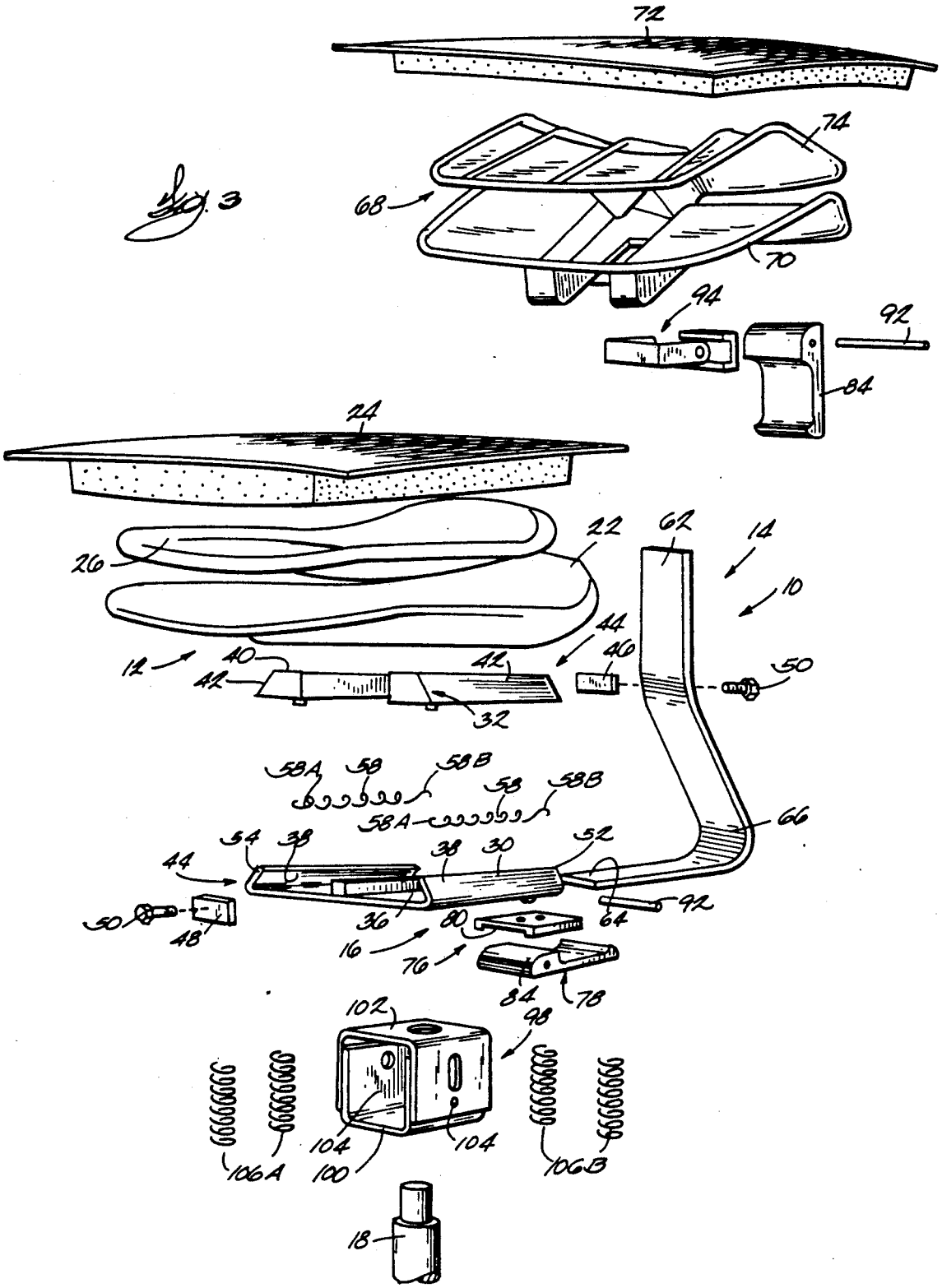
FIG. 3 is an exploded perspective view of base member and associated seat support and backrest support members of the chair shown in FIG. 1.

A chair 10 is shown in FIGS. 1 to 3 that embodies the features of the invention. The chair 10 comprises a seat support member 12, a backrest support member 14, and a base member 16 to which the seat support member 12 and the backrest support member 14 are attached.

The base member 16 is connected to a pedestal 18 that supports the seat member at a desired sitting height above the ground. In the illustrated and preferred embodiment, the pedestal 18 includes four wheels or casters 20 permitting easy movement of the chair 10 on the ground.

In accordance with the invention, the seat support member 12 and the backrest support member 14 are each individually movable relative to the base member 16 to accommodate persons of differing height, weight, build and physical preference.

The seat support member 12 of the chair 10 can be variously constructed. In the illustrated embodiment (as best shown in FIG. 3), the seat support member 12 comprises a bottom plate 22 and a seat cover 24. The bottom plate 22 is preferably made of a sturdy plastic or metal material. The seat cover 24 is preferably cloth or plastic and includes a cushion material such as foam rubber. An intermediate insert 26 may also be provided between the bottom plate 22 and seat cover 24 for added support and comfort.

The base member 16 includes first means 28 that engages the seat support member 12 and permits the user to move the seat support member 12 relative to the base member 16 between a forward seated position (shown in phantom lines in FIG. 2) and a rearward seated position (shown in solid lines in FIG. 2). The first means 28 thereby provides the desirable ergonomic feature of back-to-seat depth adjustment to meet the needs and comfort of the individual user.

Figure 5B:
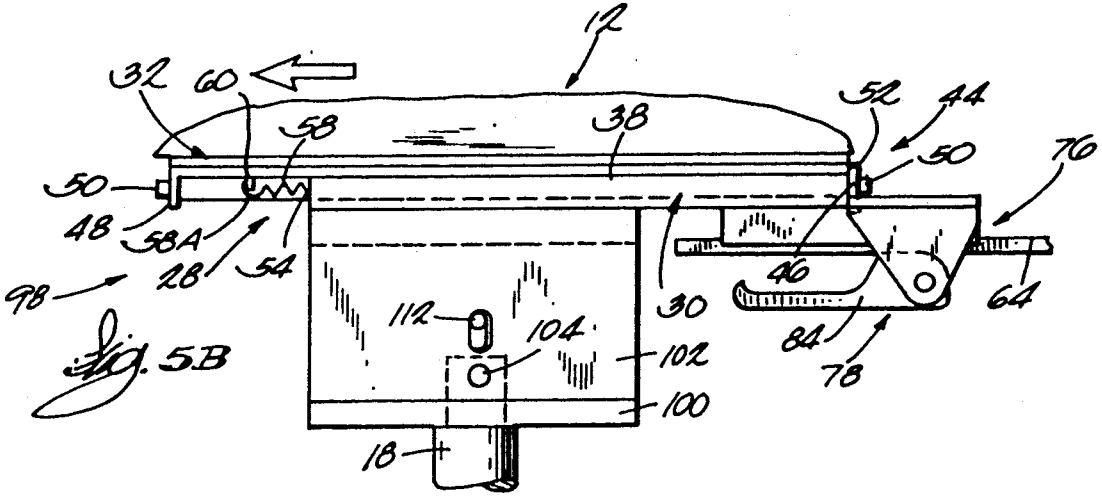
FIGS. 5A and 5B are side sectional views, taken generally along line 5—5 in FIG. 4, showing the movement of the seat support member between a rearward position (FIG. 5A) and a forward position (FIG. 5B)
Figure 5A:
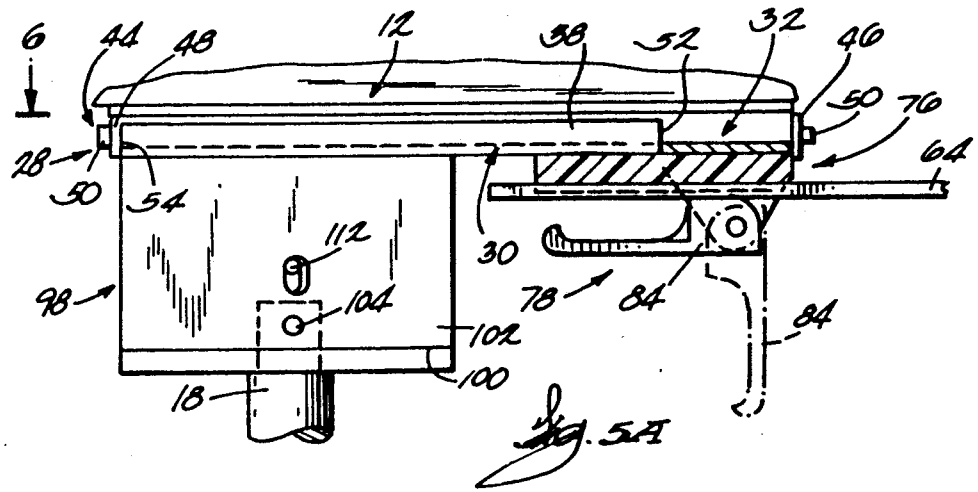
Figure 4:
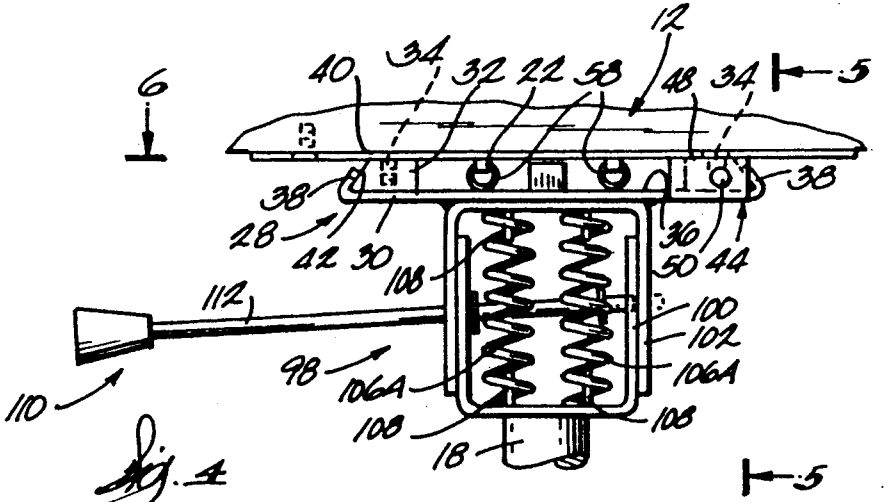
FIG. 4 is an enlarged assembled front view of the base member and associated seat support member of the chair shown in FIG. 1.
Figure 6A:
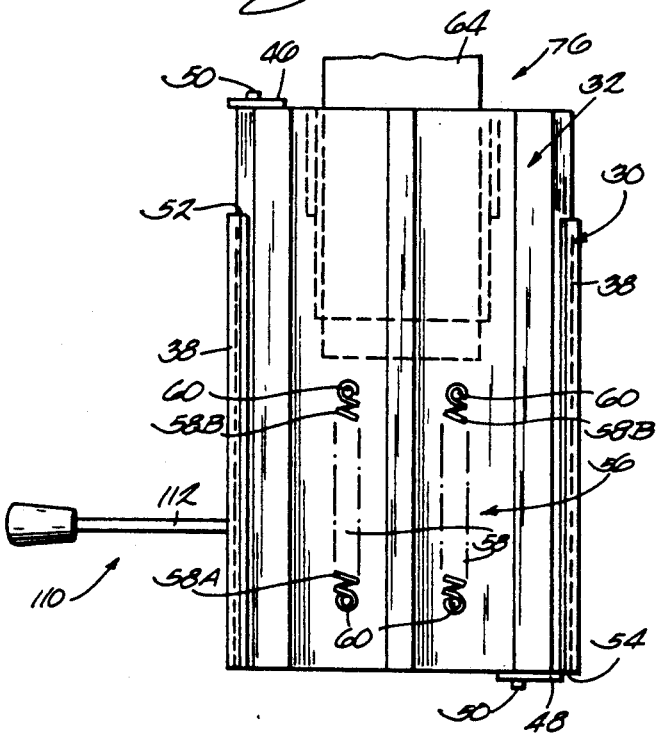
FIGS. 6A and 6B are top views, taken generally along line 6—6 in FIG. 4, showing the movement of the seat support member between a rearward position (FIG. 6A) and a forward position (FIG. 6B)
Figure 6B:
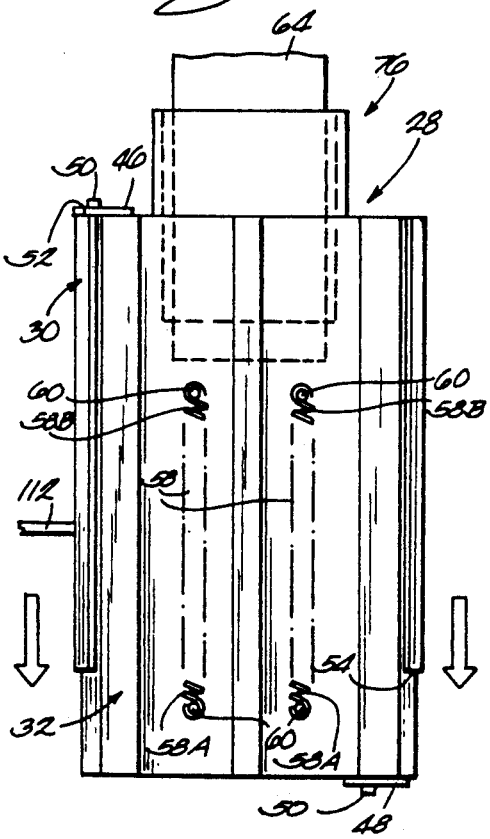

The first means 28 may be variously constructed. In the illustrated and preferred embodiment (as best shown in FIGS. 3 and 4), the first means 28 comprises a channel member 30 and a runner 32 which is slidably engaged within the channel member 30. Relative axial, in this case horizontal, movement between the channel member 30 and the runner 32 is thereby permitted. This relative movement is shown in FIGS. 6A and 6B from the standpoint of looking down from the top of the chair 10. The relative movement is also shown in FIGS. 5A and 5B from the standpoint of looking from the side of the chair 10.

The bottom plate 22 of the seat support member 12 is attached by suitable fasteners 34 to the runner 32 (see FIG. 4). In this arrangement, the channel member 30 is welded or otherwise suitably attached to the pedestal 18. However, it should be appreciated that the association of seat support member 12 and base on the runner 32 and channel member 30 could be reversed, with the seat support member 12 attached to the channel member 30 and the runner 32 attached to the base.

In the illustrated and preferred embodiment (as best shown in FIGS. 3 and 4), the channel member 30 includes a bottom wall 36 and two inwardly sloped, or beveled, sidewalls 38. This arrangement gives the channel member 30 a generally dovetail-shaped configuration. The runner 32 likewise includes a top wall 40, to which the seat support member 12 is attached, and two outwardly sloped, or beveled, sidewalls 42. This arrangement forms a dovetail-shaped configuration for the runner 32 that slidably mates with the dovetail-shaped configuration of the channel member 30 (as shown in FIG. 4). This mating arrangement permits, in a straightforward manner, the desired relative axial movement between the channel member 30 and runner 32, while preventing lateral separation of the two parts.

In the illustrated and preferred embodiment, limit means 44 is provided for restricting the relative movement of the runner 32 within the channel member 30 between the two selected laterally spaced positions corresponding to the forward and rearward seated position.

The limit means 44 may be variously constructed. In the illustrated embodiment (as best shown in FIGS. 5A/B and 6A/B), the runner 32 is longer in axial length than the channel member 30. In this arrangement, the limit means 44 comprises downwardly depending first and second flanges 46 and 48 each attached by screws 50 to opposite end walls 52 and 54 of the runner 32. When the runner 32 reaches the position corresponding to the forward seated position (shown in FIGS. 5B and 6B), the first flange 46 abuts against the rear end wall 52 of the channel member 30, thereby preventing further forward axial movement. Likewise, when the runner 32 reaches the position corresponding to the rearward seated position (shown in FIGS. 5A and 6A), the second flange 48 abuts against the front end wall 54 of the channel member 30, thereby preventing further rearward axial movement.

The first means 28 also includes means 56 for biasing the seat support member 12 toward the rearward position. The biasing means 56 may be variously constructed. In the illustrated embodiment the bias means 56 comprises one or more springs 58 attached to the channel member 30 and runner 32. In the illustrated embodiment, two springs are provided.

The springs 58 are attached at one end 58A by screws 60 or the like to the runner 32 adjacent to its forwardmost end wall 54. The opposite ends 58B of the springs 58 are attached by screws 60 or the like to the channel member 30 in a stretched, or tensioned, position, so that the normal contraction force of the springs 58 will urge the runner 32 toward the position where the second flange 48 abuts against the front end wall 54 of the channel member 30 (shown in FIG. 6A). The seat support member 12 is thereby biased by the springs 58 toward the rearward seated position (also shown in FIG. 5A).

When seated upon the chair 10, a user can apply an external horizontal force to move the seat support member 12 forwardly against the biasing force of the springs 58 until the forward seated position is reached (shown in FIGS. 5B and 6B). As shown in FIG. 6B, the movement will further stretch the springs 58. The user can selectively apply forces while seated on the chair 10 to adjust and retain the position of the seat support member 12 within a range of positions between the rearward and forward seated positions. Upon standing, the user removes the external forces, and the contraction force of the springs 58 will urge the runner 32 back toward the original rearward seated position shown (FIGS. 5A and 6A).

Attention is now directed to the backrest support member 14 of the chair 10, which can likewise be variously constructed. In the illustrated and preferred embodiment (see, in particular, FIGS. 2 and 3), the backrest support member 14 is of one-piece construction, being made from molded or extruded plastic or metal. In this arrangement, the backrest support member 14 is preformed into a generally J-shape configuration. This J-shape configuration includes a generally vertically oriented upper end portion 62, a generally horizontally oriented lower end portion 64, and an intermediate arcuate section 66.

A backrest 68 is attached to the upper end portion of the backrest support member 14. As shown in FIG. 3, the backrest 68 (like the seat support member 12) preferably includes a bottom plate 70 made of a sturdy plastic or metal material and a cloth or plastic seat cover 72 that includes a cushion material such as foam rubber. In addition, an intermediate insert 74 may also be provided between the bottom plate 70 and seat cover 72 for added support and comfort.

As shown by arrows in FIG. 2, the backrest 68 is itself preferably adjustable up and down along the upper end portion 62 of the backrest support member 14 in a manner that will be described in greater detail later. This provides the desirable ergonomic feature of backrest adjustment.

In accordance with another aspect of the invention, the base member 16 includes second means 76 engaging the backrest support member 14 and being operative for permitting movement of the backrest support member 14 relative to the base member 16 independent of the movement of the seat support member 12, which is also attached to the base member 16. More particularly, the second means 76 is operative for allowing movement of the backrest support member 14 in a first direction toward the base member 16 (shown in solid lines in FIG. 2), thereby allowing the user to bring the backrest 68 closer to the seat support member 12. The second means 76 is also operative for allowing movement of the backrest support member 14 in a second direction away from the base member 16 (shown in phantom lines in FIG. 2), thereby allowing the user to move the backrest 68 away from the seat support member 12. In the illustrated and preferred embodiment, the second means 76 includes means 78 for locking the backrest support member 14 in the desired position relative to the base member 16.

Figure 7:
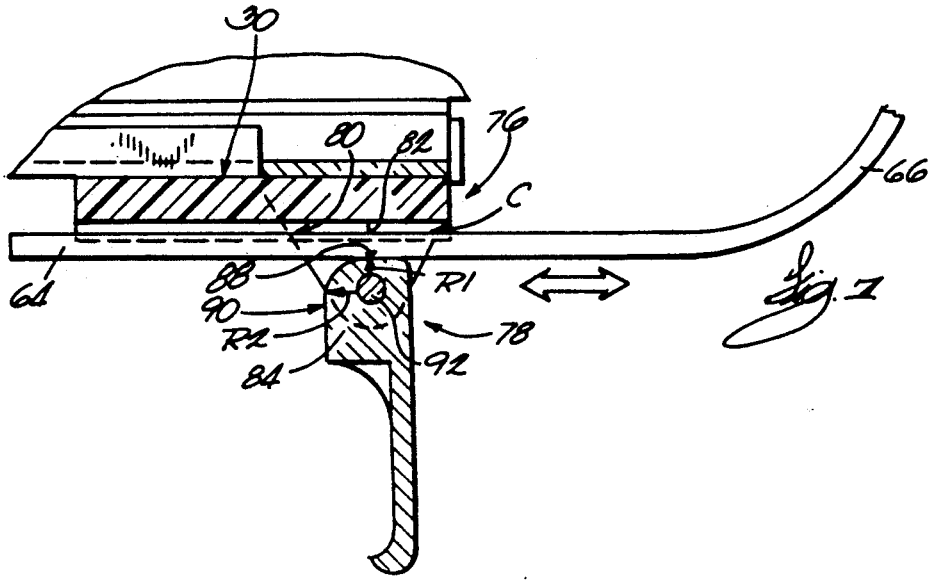
FIG. 7 is a side sectional view of the cam actuated locking mechanism for the backrest support member that embodies the features of the invention, shown in an unlocked position.
Figure 8:
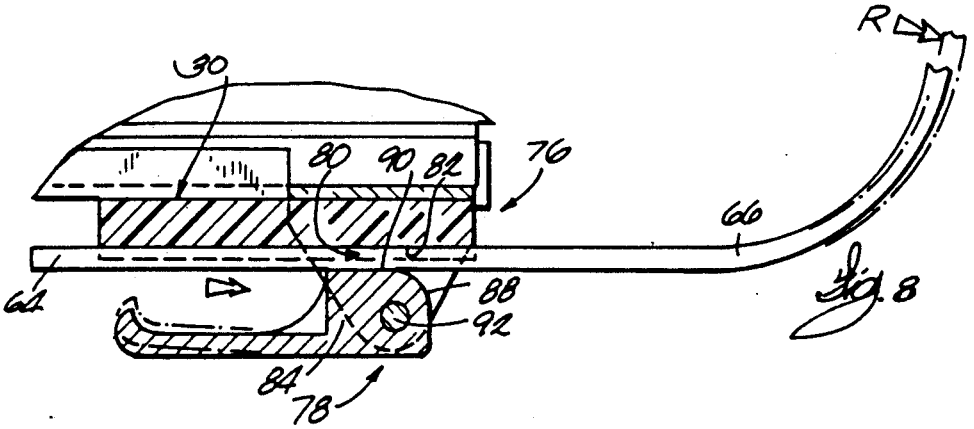
FIG. 8 is a side sectional view of the cam actuated locking mechanism shown in FIG. 7, but in a locked position.

The second means 76 may also be variously constructed. In the illustrated embodiment (as best shown in FIGS. 7 and 8), the second means 76 takes the form of a second channel 80 formed along the underside of the channel member 30. The second channel 80 is sized so that there is normally a clearance between the lower end portion 64 of the backrest support member 14 and the interior wall 82 of the channel 80. This clearance is identified by the letter C in FIG. 7. Due to the clearance C, the lower end portion 64 of the backrest support member 14 is slidably within the channel 80 (as shown by arrows in FIG. 7). This arrangement permits adjustment of the backrest support member 14 either toward or away from the base member 16, as before described and shown in FIG. 2.

The locking means 78 may also be variously constructed. It can, for example, take the form of a conventional screw lock assembly. However, in accordance with another aspect of the invention, the locking means 78 comprises a low profile, cam actuated locking mechanism that is best shown in FIGS. 7 and 8.

More particularly, the locking means 78 includes a lever arm 84 pivotally attached to the channel member 30. The lever arm 84 includes a camming surface 86 that extends from a first surface portion 88 positioned a first radial distance from the pivot axle 92 of the lever arm 84 (R1 in FIG. 7) to a second surface portion 90 positioned a second radial distance from the pivot axle 92 (R2 in FIG. 7). R2 is a greater radial distance than R1.

When the lever arm 84 is located in a first position (shown in FIG. 7), which in the illustrated embodiment is generally upright and perpendicular to the plane of the channel 80, the lower end portion 64 of the backrest support member rests against the first camming surface portion 88 out of contact with the interior wall 82 of the channel 80. In this position, the heretofore described clearance C between the lower end portion 64 of the backrest support member 14 and the interior wall 82 of the channel 80 exists. The lower end portion 64 is thereby slidably moveable within the second channel 80.

When the lever arm 84 is moved toward a second position (shown in FIG. 8), which in the illustrated embodiment is generally horizontal and parallel to the plane of the channel 80, the second camming surface portion 90 presses against the lower end portion 64 of the backrest support member 14 against the interior wall 82 of the channel 80. The abovedescribed clearance C is eliminated. The surface contact applied by the second camming surface portion 90 and the interior channel wall 82 creates frictional forces that securely lock the lower end portion 64 of the backrest support member 14 in place within the channel 80. When the lever arm 84 is positioned in its second position, the backrest support member 14 is thereby locked into the desired position within the channel 80.

In accordance with another aspect of the invention, the locking means 78 is operative for biasing the lever arm 84 toward its second, or locked, position in response to the forces normally applied by a user when seated on the chair 10. More particularly, as shown in FIG. 8, when seated on the chair 10, the user will normally apply a resting force (designated by the letter R in FIG. 8) on the backrest 68. The resting force R, if not resisted, would tend to move the backrest support member 14 away from the seat support member 12, as shown in phantom lines in FIG. 8. The application of the resting force R upon the second camming surface portion 90 pivots the lever arm 84 in a direction toward its second, or locked position, as shown by an arrow and in phantom lines in FIG. 8 (which, in FIG. 8, is a clockwise direction).

The resting force R normally applied by the user, then, in effect biases the lever arm 84 toward its locked position. The resting force R normally exerted by the user will then maintain a tightening force upon the lever arm 84 to maintain the pressing engagement between the second camming surface portion 90 and the adjacent surface of the lower end portion 64 of the backrest support member 14.

The cam actuated locking arrangement provides for a low profile locking assembly. It also is easily manipulated by the user and resists loosening.

Figure 17:
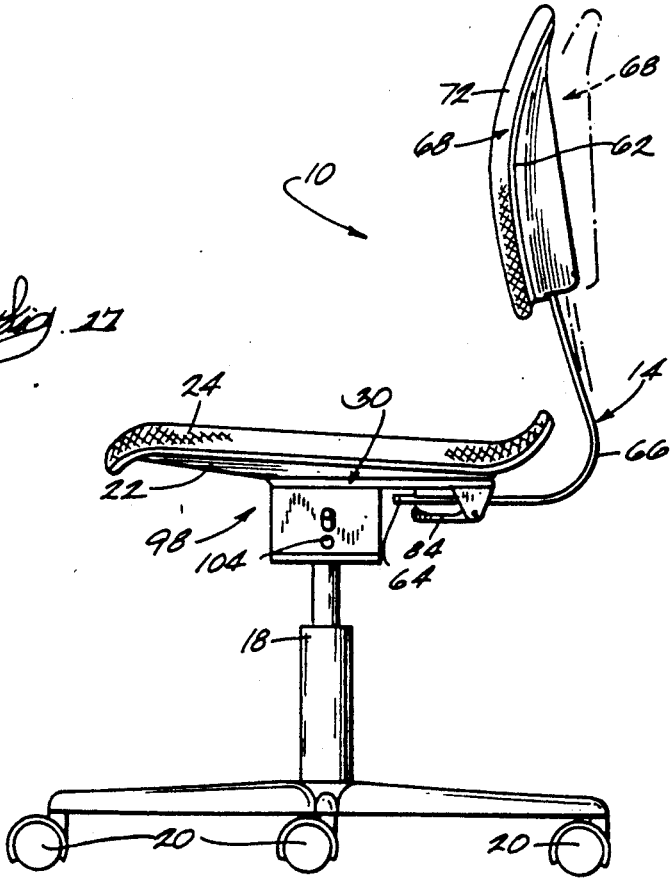
FIG. 17 is a side elevation view of the chair shown in FIG. 1 indicating the flexing movement of the associated backrest support member.

In the illustrated and preferred embodiment (see FIG. 17), the material from which the backrest support member 14 is made permits the user, by leaning back upon the backrest, to resiliently bend or flex the upper end portion 62 relative to the arcuate middle portion 66 when the backrest support member 14 is suitably locked in position. The J-shape configuration provides added strength to lend the necessary back support while providing the resiliency necessary to accommodate the desired flexing movement. Added comfort and lumbar support is thereby provided.

Figure 9:
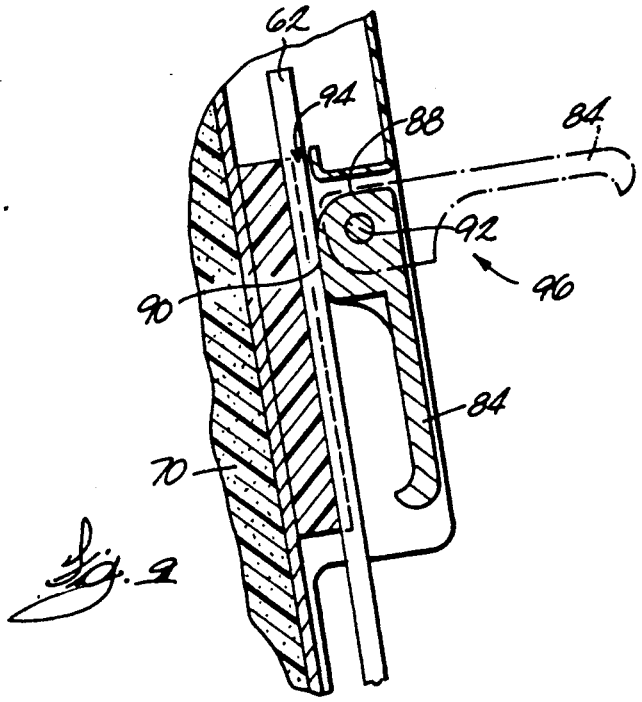
FIG. 9 is a side sectional view of the cam actuated locking mechanism for the backrest that embodies the features of the invention.

Preferably, as before discussed, the backrest 68 is adjustable up and down along the upper end portion 62 of the backrest support member 14. For this purpose (see FIGS. 3 and 9), a third channel 94 is formed along the rear surface of the backrest 68, which slidably receives the end portion 62. In this arrangement, as also shown in FIG. 9, means 96 is also provided for locking the backrest 68 in a desired position. The means 96 includes the same cam-actuated locking arrangement just described. For this reason, the component parts of the locking means 96 are given the same reference numerals in the drawings. The desirable ergonomic feature of back height adjustment is thereby provided.

In the illustrated and preferred embodiment, the base member 16 also includes third means 98 operative for pivoting the base member 16 about a horizontal axis with respect to the pedestal 18. This provides still additional degree of adjustability to meet the needs and comfort of the user.

While the third means 98 may be variously constructed, in the illustrated embodiment (best shown in FIG. 10), a bracket assembly comprising two generally U-shaped brackets 100 and 102 is provided. One U-shape bracket 100 nests within the other U-shape bracket 102, and for this reason the brackets will be referred to as the inner and outer brackets, respectively. The brackets 100 and 102 are attached by pins 104 about a common pivot axis, so that the brackets 100 and 102 will pivot relative to each other (see FIGS. 15 and 16).

In the illustrated arrangement, the inner bracket 100 is attached to the pedestal 18, and the outer bracket 102 is attached to the base member 16. The brackets 100 and 102 are thereby arranged to permit pivotal movement of the base member 16, and thus the entire seat support member 12 attached thereto, in a forward direction (shown in FIG. 16 to be generally counterclockwise about the pivot axis 104) and in a rearward direction (shown in FIG. 15 to be generally clockwise about the pivot axis 104) in response to external tipping forces applied by the user.

The third means 98 also includes means 106 for normally biasing the brackets 100 and 102 to retain the seat support member 12 carried by the base member 16 in a generally horizontal position (shown in FIG. 2). While the biasing means 106 can be variously constructed, in the illustrated embodiment (see FIG. 10), two pairs of springs 106 A/B are provided. The pairs 106 A/B are attached by pins 108 at opposite ends of the nested brackets 100 and 102 in the path of pivotal movement (see also FIGS. 15 and 16).

Figure 10:
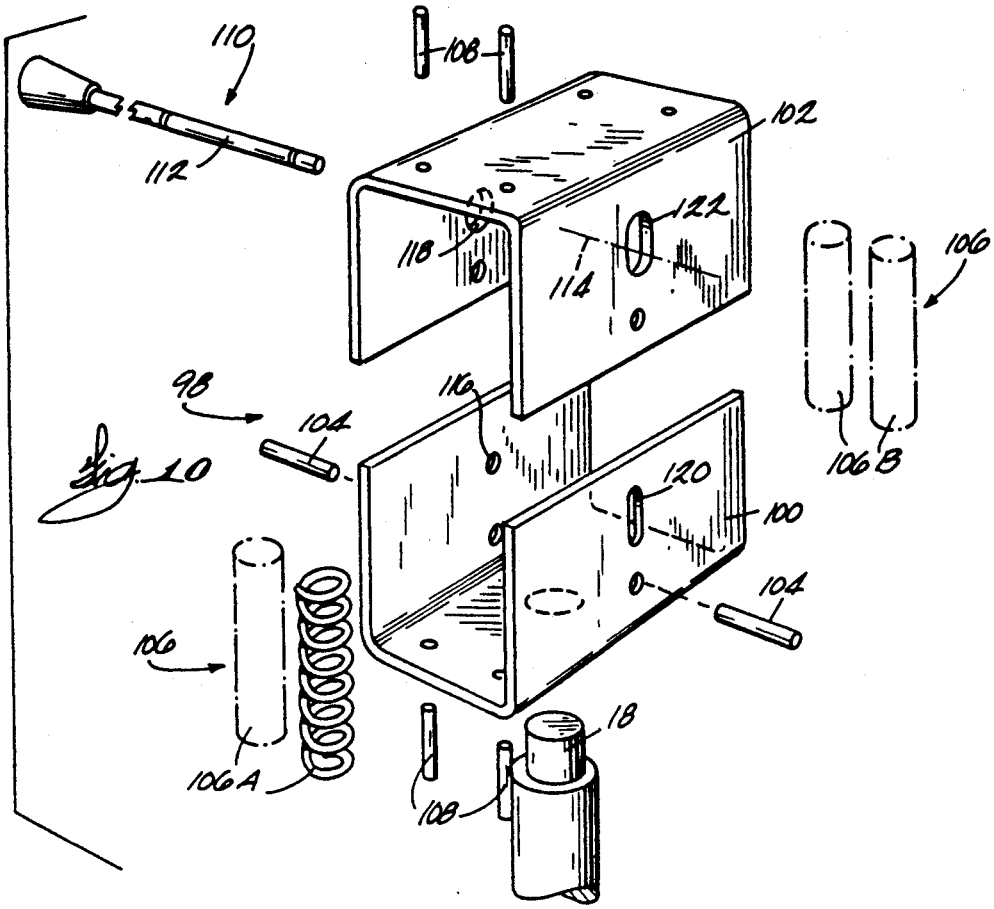
FIG. 10 is an enlarged exploded perspective view of the tilting mechanism for the seat support member that embodies the features of the invention.
Figure 15:
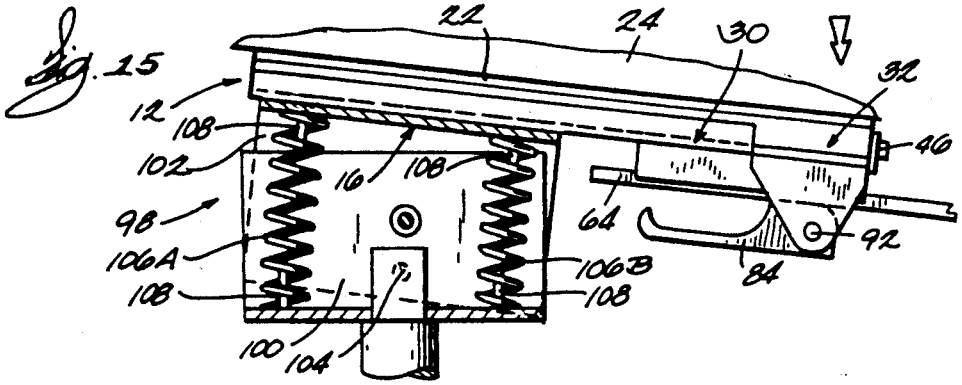
FIG. 15 is a side section view of the tilting mechanism shown in FIG. 10, with the seat support member tilted rearwardly.
Figure 16:
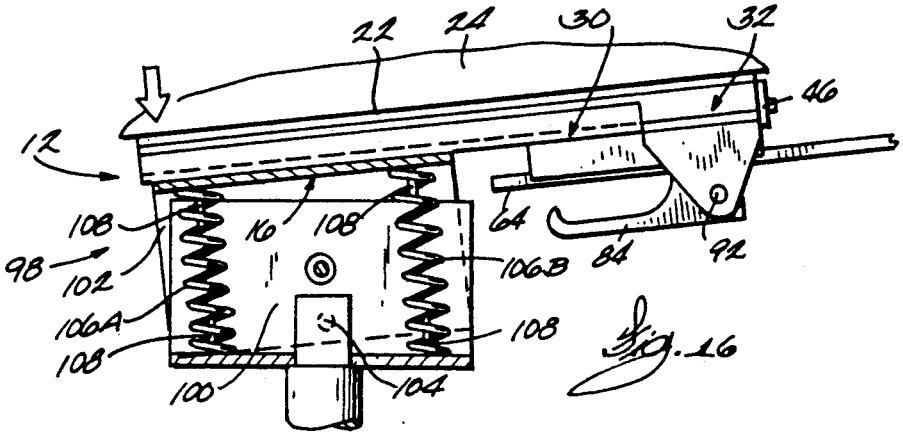
FIG. 16 is a side section view of the tilting mechanism shown in FIG. 10, with the seat support member tilted forwardly.

When the seat member atop the base member 16 is in a horizontal position, the springs are in a normally rested, unstressed position (shown in FIGS. 4 and 10). As shown in FIGS. 15 and 16, pivotal movement of the seat support member 12 either forwardly or rearwardly in response to an external force will compress one pair of springs 106 A/B while stretching the opposite pair of springs 106 A/B. Upon removal of the external force, the pairs of springs 106 A/B independently return to their rested positions and, in doing so, cooperatively return the seat support member 12 to its normal horizontal position.

The base member 16 further includes pivot control means 110 operatively connected with the third means for selectively permitting pivotal movement of the base member 16 in one desired direction while preventing pivotal movement of the base member 16 in another direction. In the illustrated embodiment, the pivot control means 110 in use permits forward tilting motion of the seat support member 12, while preventing rearward tilting motion of the seat support member 12. The invention thus provides the desirable ergonomic feature of forward and back tilt on a selective basis.

Figure 11:
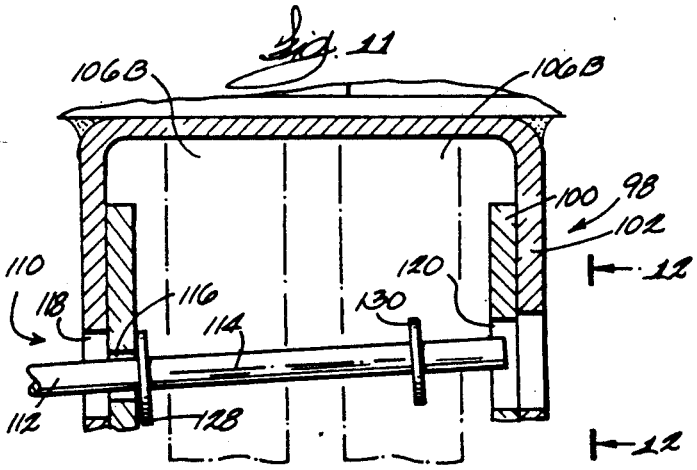
FIG. 11 is a partial end view, in section, of the tilting mechanism shown in FIG. 10, with the associated control rod in a first, or unlocked position.
Figure 13:
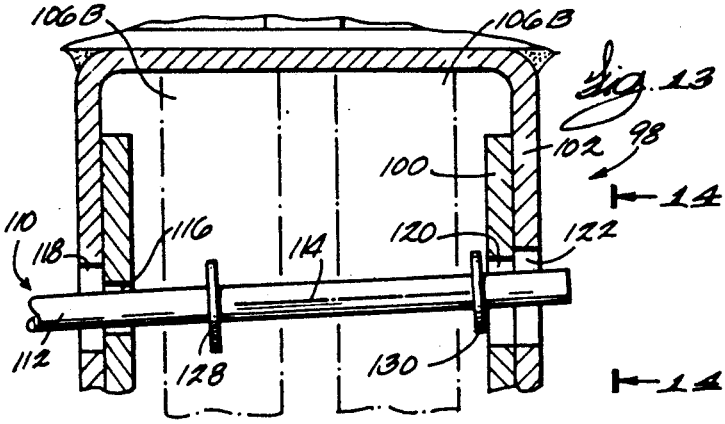
FIG. 13 is a partial end view, in section, of the tilting mechanism shown in FIG. 10, with the associated control rod in a second, or locked position.

The pivot control means 110 can be variously constructed. In the illustrated and preferred embodiment, a pivot control rod 112 is provided that extends through the nested brackets 100 and 102 along an axis 114 that lies above the pivot axis 104 of the bracket assembly (see FIGS. 11 and 13). More particularly, the control rod 112 passes through a pair of inner and outer entry openings 116 and 118 located along the axis 114 on one side of the nested inner and outer brackets 100 and 102, respectively. The control rod 112 also passes through an oppositely spaced pair of inner and outer exit openings 120 and 122 located along the axis 114 on the opposite side of the nested inner and outer brackets 100 and 102, respectively.

Figure 12:
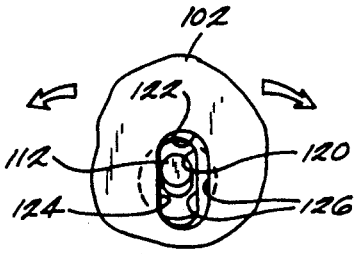
FIG. 12 is a view of the tilting mechanism taken generally along line 12—12 in FIG. 11.
Figure 14:
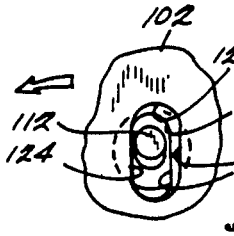
FIG. 14 is a view of the tilting mechanism taken generally along line 14—14 in FIG. 13.

As can be seen in FIG. 10, the entry openings 116 and 118 are generally circular in configuration whereas the exit openings 120 and 122 are generally elongated in configuration in a direction generally perpendicular to the base member 16 (see also FIGS. 12 and 14). As can also be seen in FIG. 10, the outer entry and exit openings 118 and 122 are radially larger than the inner entry and exit openings 116 and 120. As can be seen in FIGS. 12 and 14, when the brackets 100 and 102 are nested together, the forward side edges 124 of the elongated inner and outer exit openings 120 and 122 are generally aligned, while the rearward edges 126 are not.

The control rod 112 is movable along the axis 114 between spaced first and second positions. In the first position (shown in FIG. 11), the control rod 112 extends through the inner and outer entry openings 116 and 118, but not through both exit openings 120 and 122. A tab 128 on the control rod 112 abuts against the interior of the inner bracket 100 when the control rod 112 is in this first position to prevent withdrawal of the rod 112 altogether from the entry openings 116 and 118.

Due to the arrangement and relative dimensions of the inner and outer entry openings when the control rod 112 is in its first position (see FIGS. 11 and 12), pivotal movement of the brackets 100 and 102 can proceed unimpeded in both the counterclockwise, or forward tilting, direction and clockwise, or rearward tilting, direction (as shown in FIG. 12).

In its second position (shown in FIGS. 13 and 14), the control rod 112 extends through both inner and outer entry openings 116 and 118 and both inner and outer exit openings 120 and 122. A tab 130 on the control rod 112 abuts against the interior of the inner bracket 100 when the control rod 112 is in this second position to prevent over-extension of the rod from the exit openings 120 and 122.

As shown in FIG. 14, due to the partial alignment and relative dimensions of the inner and outer exit openings 120 and 122 when the control rod 112 is in its second position, pivotal movement of the brackets 100 and 102 as above describe can proceed unimpeded only in the counterclockwise, or forward tilting, direction. Interference of the control rod 112 against the aligned forward edges 124 of the exit openings 120 and 122 prevents pivotal movement in the clockwise, or rearward tilting, direction.

It should be appreciated that different results can be obtained by altering the relative dimensions and alignment of the inner and outer exit openings 120 and 122. For example, by aligning the rearward edges 126 of the exit openings 120 and 122 and providing interference of the control rod 112 against these aligned rearward edges 126, forward tilting movement can be prevented, while allowing rearward tilting movement. Also, by aligning both the forward and rearward edges 124 and 126 of the exit openings 120 and 122 and providing interference of the control rod 112 simultaneously against both aligned forward and rearward edges 124 and 126, all tilting movement of the base member 16 can be prevented.

It should also be appreciated that base member 16 that embodies the features of the invention can be attached to the pedestal 18 with a bracket (not shown) preventing all forward and rearward tilting movement.

Various features of the invention are set forth in the following claims.

We claim:

1. A chair comprising:

a seat support member;

a backrest support member; and a base member to which said seat support member and said backrest support member are attached, said base member including:

first means engaging said seat support member for permitting sliding, generally horizontal movement of said seat support member between a forward seated position and a rearward seated position relative to said base member; and second means engaging said backrest support member for permitting sliding, generally horizontal movement of said backrest support member toward and away from said base member, independent of the movement of said seat support member.

2. A chair according to claim 1 further comprising a pedestal connected to said base for supporting said seat support member at a desired sitting height above the ground;

wherein said base member includes third means operative for tilting said base member about a horizontal axis relative to said pedestal.

3. A chair according to claim 2 wherein said first means includes means for operatively connected with said third means for selectively permitting tilting movement of said base member in one direction while preventing tilting movement of said base member in another direction.

4. A chair according to claim 2 wherein said third means includes means for biasing said base member toward a generally horizontal position while allowing tilting of said base member about said horizontal axis in response to external force.

5. A chair according to claim 1 wherein said first means includes means for biasing said seat support member toward said rearward seated position.

6. A chair according to claim 1 wherein said first means includes a channel, a runner slidably engaging said channel to permit relative movement between said channel and said runner, and limit means for restricting the relative movement of said channel and said runner between two selected laterally spaced positions corresponding to said forward and rearward seated position; and wherein said seat support member is attached to one of said channel and said runner.

7. A chair according to claim 6 wherein said channel includes a generally dovetail-shaped configuration, and said runner includes a mating dovetail-shaped configuration that slidably engages said channel configuration to permit relative axial movement while preventing lateral separation of said channel and said runner.

8. A chair according to claim 7 wherein one of said channel and runner is longer in axial length than the other one of said channel and runner, and wherein said limit means comprises a lip extension on the longer one of said channel and said runner that engages a side edge of the other one of said channel and said runner to prevent further axial movement therebetween.

9. A chair according to claim 1 wherein said second means includes means for locking said backrest support member in a desired position relative to said base member.

10. A chair according to claim 9 wherein said locking means comprises a lever pivotally movable on said base member and cam means operatively connected with said lever for selectively engaging and disengaging said backrest support member in response to pivotal movement of said lever.

11. A chair according to claim 9 wherein said second means includes means for biasing said locking means toward a position that locks said backrest support member in response to the forces normally applied by a user when seated on the chair.

12. A chair comprising:

a seat support member;

a backrest support member; and a base member to which said seat support member and said backrest support member are attached, said base member including:

first means engaging said seat support member for permitting movement of said seat support member between a forward seated position and a rearward seated position relative to said base member;

second means engaging said backrest support member for permitting sliding, generally horizontal movement of said backrest support member toward and away from said base member, independent of the movement of said seat support member; and a pedestal connected to said base member for supporting said seat support member at a desired sitting height above the ground, said base member further including third means operative for tilting said base member about a horizontal axis relative to said pedestal.

13. A chair according to claim 12 wherein said base member includes means operatively connected with said third means for selectively permitting tilting movement of said base member in one direction while preventing tilting movement of said base member in another direction.

14. A chair according to claim 13 wherein said third means includes means for biasing said base member toward a generally horizontal position while allowing tilting of said base member about said horizontal axis in response to external force.

15. A chair according to claim 12 wherein said first means includes means for biasing said seat support member toward said rearward seated position.

16. A chair according to claim 12 wherein said first means includes a channel, a runner slidably engaging said channel to permit relative movement between said channel and said runner, and limit means for restricting the relative movement of said channel and said runner between two selected laterally spaced positions corresponding to said forward and rearward seated position; and wherein said seat support member is attached to one of said channel and said runner.

17. A chair according to claim 16 wherein said channel includes a generally dovetail-shaped configuration, and said runner includes a mating dovetail-shaped configuration that slidably engages said channel configuration to permit relative axial movement while preventing lateral separation of said channel and said runner.

18. A chair according to claim 17 wherein one of said channel and runner is longer in axial length than the other one of said channel and runner, and wherein said limit means comprises a lip extension on the longer one of said channel and said runner that engages a side edge of the other one of said channel and said runner to prevent further axial movement therebetween.

19. A chair according to claim 12 wherein said first means permits sliding, generally horizontal movement of said seat support member between the forward seated position and the rearward seated position relative to said base member.

20. A chair comprising a seat support member;

a base member including first means engaging said seat support member and being operative for permitting movement of said seat support member between a forward seated position and a rearward seated position relative to said base member, said first means including a channel having a generally dovetail-shaped configuration, a runner having a mating dovetail-shaped configuration that slidably engages said channel configuration to permit relative axial movement while preventing lateral separation of said channel and said runner, one of said channel and runner being longer in axial length than the other one of said channel and runner, said seat support member being attached to one of said channel and said runner, and limit means for restricting the relative movement of said channel and said runner between two selected laterally spaced positions corresponding to said forward and rearward seated position, said limit means comprising a lip extension on the longer one of said channel and said runner that engages a side edge of the other one of said channel and said runner to prevent further axial movement therebetween.

21. A chair according to claim 20 wherein said first means includes means for biasing said seat support member toward said rearward seated position.

22. A chair comprising:

a seat support member;

a base member to which said seat support member is attached; and a pedestal connected to said base for supporting said seat support member at a desired sitting height above the ground;

said base member including pivot means operative for tilting said base member forwardly and rearwardly about a horizontal axis relative to said pedestal and comprising an outer bracket, an inner bracket nested within said outer bracket, pin means coupling said inner and outer brackets for tilting said inner and outer brackets relative to each other about a common pivot axis, and spring means operatively attached to said inner and outer brackets for biasing said brackets toward a generally non-tilted position, and control means operatively connected with said pivot means for selectively permitting tilting of said base member in one forward or rearward direction while preventing pivotal movement of said base member in the other forward or rearward direction, said control means including a pivot control rod extending through said inner and outer brackets along a second axis that is spaced from the pivot axis of said brackets, said control rod being passable through an oppositely spaced pair of inner and outer exit openings located along said second axis on the opposite side of said inner and outer brackets, said inner and outer exit openings being of different sizes and being aligned along at least one peripheral edge and non-aligned along at least an opposite peripheral edge when said brackets are in said untilted position, said control rod being movable along said second axis between a first position, in which said control rod extends through both of said inner and outer entry openings but not both of said inner and outer exit openings, to allow tilting of said inner and outer brackets, and a second position, in which said control rod extends through both inner and outer entry openings and both inner and outer exit openings adjacent said aligned peripheral edge thereof to selectively prevent tilting of said inner and outer brackets in said one direction.

* * * * *

UNITED STATES PATENT AND TRADEMARK OFFICE

CERTIFICATE OF CORRECTION

PATENT NO. : 5,035,466

DATED : July 30, 1991

INVENTOR(S) : Marty K. Mathews and Jeffrey A. Weber

It is certified that error appears in the above—identified patent and that said Letters Patent is hereby corrected as shown below:

Column 9, line 59:

Delete "first means" and substitute --- base member ---.

Column 12, line 45:

After "through" insert --- a pair of inner and outer entry openings located along said second axis on one side of said inner and outer brackets, said inner and outer entry openings being of different sizes, said control rod being further passable through --.

Signed and Sealed this

Twelfth Day of January, 1993

*Attest:*

*Attesting Officer*

DOUGLAS B. COMER

*Acting Commissioner of Patents and Trademarks*